US007974558B2

(12) United States Patent
Choi et al.

(10) Patent No.: US 7,974,558 B2
(45) Date of Patent: Jul. 5, 2011

(54) TONER CARTRIDGE LOCKING APPARATUS, IMAGE FORMING APPARATUS HAVING THE SAME, TONER CARTRIDGE, AND MOUNTING AND DISMOUNTING METHOD FOR A TONER CARTRIDGE

(75) Inventors: Sam-seok Choi, Suwon-si (KR); Jin-hyung Lee, Seoul (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 770 days.

(21) Appl. No.: 12/027,336

(22) Filed: Feb. 7, 2008

(65) Prior Publication Data

US 2008/0317510 A1 Dec. 25, 2008

(30) Foreign Application Priority Data

Jun. 25, 2007 (KR) ..... 10-2007-0062479
Aug. 27, 2007 (KR) ..... 10-2007-0086290

(51) Int. Cl.
*G03G 15/08* (2006.01)

(52) U.S. Cl. ..... 399/258; 399/262

(58) Field of Classification Search ..... 399/13, 399/258, 262

See application file for complete search history.

(56) References Cited

U.S. PATENT DOCUMENTS 5,568,237 A 10/1996 Ishida et al.

FOREIGN PATENT DOCUMENTS

| | | |
|---|---|---|
| CN | 1503072 | 6/2004 |
| EP | 0668546 | 8/1995 |
| EP | 1 722 279 | 11/2006 |
| EP | 1 840 668 | 10/2007 |
| JP | 2006-208574 | 8/2006 |
| KR | 1999-30324 | 4/1999 |
| RU | 2198121 | 2/2003 |
| RU | 63289 | 5/2007 |
| WO | 99/05446 | 2/1999 |

OTHER PUBLICATIONS

Examination Report issued Jul. 27, 2009 in EP Application No. 08153194.9.

Russian Decision on Grant issued Aug. 10, 2009 in RU 2008114663.

Chinese Office Action issued Oct. 9, 2009 in CN Application No. 200810093042.9.

*Primary Examiner* — William J Royer

(74) *Attorney, Agent, or Firm* — Stanzione & Kim, LLP

(57) ABSTRACT

The present general inventive concept relates to a toner cartridge locking apparatus, which includes a rotation handle rotatably disposed at a first end of a toner tank, and having a locking blade formed at an outer circumferential surface thereof, and a hooking portion disposed at a developing unit to which the toner tank is mounted, wherein when the rotation handle is rotated in a predetermined angle, the locking blade of the rotation handle is inserted into the hooking portion.

56 Claims, 11 Drawing Sheets

FIG. 1
(CONVENTIONAL)
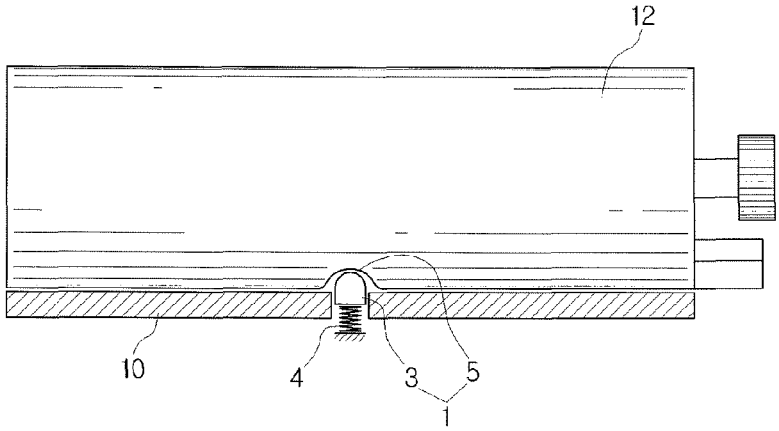

TONER CARTRIDGE LOCKING APPARATUS, IMAGE FORMING APPARATUS HAVING THE SAME, TONER CARTRIDGE, AND MOUNTING AND DISMOUNTING METHOD FOR A TONER CARTRIDGE

CROSS-REFERENCE TO RELATED APPLICATIONS

This application claims priority under 35 U.S.C. §119(a) from Korean Patent Applications No. 2007-62479 filed Jun. 25, 2007 and No. 2007-86290 filed Aug. 27, 2007 in the Korean Intellectual Property Office, the disclosures of which are incorporated herein by reference in their entirety.

BACKGROUND OF THE INVENTION

1. Field of the Invention

The present general inventive concept relates generally to a toner cartridge locking apparatus, image forming apparatus having the same, toner cartridge, and a mounting and dismounting method for a toner cartridge. More particularly, the present general inventive concepts relates to the toner cartridge locking apparatus, image forming apparatus having the same, toner cartridge, and mounting and dismounting method for a toner cartridge, the image forming apparatus having the same, and the mounting and dismounting method of the toner cartridge so that a variation of intended molding dimension of the toner cartridge does not affect mounting and dismounting of the toner cartridge.

2. Description of the Related Art

Generally, electrophotographic image forming apparatuses such as a laser printer, a copier, etc. form images using toner, and transfer the images onto a printing medium, thereby performing a printing operation.

Because toner is consumed during the printing operation, the image forming apparatus is required to replenish toner. Nowadays, image forming apparatuses using a detachable toner cartridge have been widely spread so that a user can replenish toner. At this time, for preventing the toner cartridge from coming out of the image forming apparatus during the printing operation, the toner cartridge needs to be locked to the image forming apparatus. For this, a toner cartridge locking apparatus that locks the toner cartridge to the image forming apparatus has been used.

FIG. 1 illustrates a conventional toner cartridge locking apparatus for an image forming apparatus.

Referring to FIG. 1, the conventional toner cartridge locking apparatus 1 for the image forming apparatus includes a fixing protrusion 3 disposed at a toner cartridge mounting portion 10 and a protrusion receiving groove 5 formed on a toner cartridge 12.

The fixing protrusion 3 is biased by an elastic member 4 to project and sink with respect to the toner cartridge mounting portion 10. A top end of the fixing protrusion 3 is formed substantially in a domed shape. The protrusion receiving groove 5 is formed in a position corresponding to the fixing protrusion 3 of the toner cartridge 12 to receive the fixing protrusion 3.

Therefore, when the toner cartridge 12 is being inserted into the toner cartridge mounting portion 10, the fixing protrusion 3 is pressed by the toner cartridge 12. When the toner cartridge 12 is completely inserted so that the protrusion receiving groove 5 of the toner cartridge 12 locates above the fixing protrusion 3, the fixing protrusion 3 enters the protrusion receiving groove 5 to lock the toner cartridge 12.

However, because the conventional toner cartridge locking apparatus 1 uses the protrusion receiving groove 5 and fixing protrusion 3 formed by a molding process to lock the toner cartridge 12, if the molded protrusion receiving groove 5 and fixing protrusion 3 of the toner cartridge 12 intended dimensions are varied, mounting and dismounting the toner cartridge 12 is difficult.

That is, if the toner cartridge locking apparatus 1 does not completely lock the toner cartridge 12, when the toner cartridge 12 receives a driving force to supply toner, the toner cartridge 12 may be pushed by the driving force, and so, come off the toner cartridge mounting portion 10. Contrarily, if the protrusion receiving groove 5 of the toner cartridge 12 is too tight for the fixing protrusion 3 of the toner cartridge mounting portion 10, the toner cartridge 12 may not be separated from the toner cartridge mounting portion 10.

Also, in the conventional toner cartridge locking apparatus 1, the fixing protrusion 3 coupled to the protrusion receiving groove 5 cannot be seen so that the user knowing whether the toner cartridge 12 is locked to the toner cartridge mounting portion 10 is difficult.

SUMMARY OF THE INVENTION

The present general inventive concept provides a toner cartridge locking apparatus to easily mount and dismount a toner cartridge without receiving an influence of variation of molding dimensions of the toner cartridge, and to which a user can easily know whether the toner cartridge is locked, an image forming apparatus having the same, and mounting and dismounting methods for the toner cartridge.

The present general inventive concept also provides a toner cartridge, and a toner tank and a rotation handle of the toner cartridge that may be used in a toner cartridge locking apparatus, to easily mount and dismount the toner cartridge by preventing an influence of variation of molding dimensions of the toner cartridge, and to which a user can easily know whether the toner cartridge is locked.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept can be achieved by providing a toner cartridge locking apparatus, which includes a rotation handle rotatably disposed at a first end of a toner tank, and having a locking blade formed at an outer circumferential surface thereof, and a hooking portion disposed at a developing unit to which the toner tank is mounted, wherein when the rotation handle is rotated in a predetermined angle, the locking blade of the rotation handle is inserted into the hooking portion.

The toner tank may include a rotation supporting portion formed substantially in a ring shape at the first end of the toner tank, and the rotation handle may include a rotating portion to rotate with respect to the rotation supporting portion of the toner tank.

The rotating portion of the rotation handle may be inserted into one of an inside and an outside of the rotation supporting portion of the toner tank.

At least one of a guiding groove and guiding projection may be formed at the rotation supporting portion of the toner tank.

The rotating portion of the rotation handle may include at least one of a guiding projection and guiding groove inserted into the at least one of the guiding groove and the guiding projection formed at the rotation supporting portion.

The at least one of the guiding groove and the guiding projection of the rotation supporting portion and the rotating portion may be formed so that the rotation handle rotates within approximately 45 degrees.

The rotating portion of the rotation handle may be formed substantially in a ring shape, and divided into at least two portions in a diameter direction of the rotation handle.

The rotation handle may include a skirt to enclose the rotating portion, the locking blade is disposed at the skirt.

The rotation handle may include a handle.

The toner cartridge locking apparatus may include a handle locking member disposed at the toner tank, wherein when the toner tank is not mounted to the developing unit the handle locking member does not allow the rotation handle to rotate, and wherein when the toner tank is mounted to the developing unit the handle locking member allows the rotation handle to rotate.

The handle locking member may include a fixing end fixed to the toner tank, and a free end biased to be separated from the toner tank, and wherein a fixing groove in which the free end of the handle locking member is inserted is formed at an inner surface of the rotation handle.

The toner cartridge locking apparatus may include a pressing projection disposed at the developing unit, wherein when the toner tank is mounted, the pressing projection presses the handle locking member toward the toner tank.

The toner tank may include a pair of protecting protrusions disposed at both sides of the handle locking member.

The locking blade of the rotation handle may include an inserting projection to project toward the toner tank.

The foregoing and/or other aspects and utilities of the present general inventive concept can also be achieved by providing a toner cartridge locking apparatus which includes a rotation handle rotatably disposed at a first end of a toner tank, and having a locking blade formed at an outer circumferential surface thereof, a hooking portion disposed at a developing unit to which the toner tank is mounted so that when the rotation handle is rotated in a predetermined angle, the locking blade of the rotation handle is inserted into the hooking portion, and a handle locking member disposed at the toner tank so that when the toner tank is not mounted to the developing unit, the handle locking member does not allow the rotation handle to rotate, and when the toner tank is mounted to the developing unit, the handle locking member allows the rotation handle to rotate.

The foregoing and/or other aspects and utilities of the present general inventive concept can also be achieved by providing an image forming apparatus which include a developing unit disposed in a main body, and including a photosensitive medium and at least one toner cartridge mounting portion to which at least one toner cartridge to supply the photosensitive medium with toner is mounted, a toner cartridge locking apparatus to lock the at least one toner cartridge mounted to the toner cartridge mounting portion of the developing unit, wherein the toner cartridge locking apparatus includes a rotation handle rotatably disposed at a first end of a toner tank, and having a locking blade formed at an outer circumferential surface thereof, and a hooking portion disposed at the developing unit to which the toner tank is mounted, wherein when the rotation handle is rotated in a predetermined angle, the locking blade of the rotation handle is inserted into the hooking portion, and a front cover disposed at the main body to cover a front surface of the developing unit in which the at least one toner cartridge mounting portion is formed.

The developing unit may include four toner cartridges, wherein one toner cartridge among the four toner cartridges has a larger size than the other three toner cartridges.

The larger size toner cartridge may include an extension portion, and the toner cartridge mounting portion in which the larger size toner cartridge is inserted includes an extension groove corresponding to the extension portion of the toner cartridge, wherein the extension groove is formed not to be interfered with the other three toner cartridge mounting portions.

The foregoing and/or other aspects and utilities of the present general inventive concept can also be achieved by providing a mounting method of a toner cartridge, the mounting method including inserting the toner cartridge into a toner cartridge mounting portion of a developing unit, and rotating a rotation handle of the toner cartridge so that a locking blade of the rotation handle rotates in a same direction as the rotation direction of the rotation handle to be caught on a hooking portion of the developing unit.

A width of the rotation handle may be wider than a width of the locking blade.

At this time, when the rotation handle rotates approximately 45 degrees, the locking blade of the rotation handle is caught on the hooking portion of the developing unit.

The foregoing and/or other aspects and utilities of the present general inventive concept can also be achieved by providing a mounting method of a toner cartridge, the mounting method including inserting the toner cartridge having a rotation handle into a toner cartridge mounting portion of a developing unit, causing a pressing projection disposed at the toner cartridge mounting portion to press a handle locking member of the toner cartridge so that the handle locking member is released from a fixing groove of the rotation handle, and rotating the rotation handle of the toner cartridge so that a locking blade of the rotation handle is caught on a hooking portion of the developing unit.

Before the toner cartridge is inserted into the toner cartridge mounting portion, a reference projection of the toner cartridge may be aligned to a reference groove formed at the toner cartridge mounting portion.

The foregoing and/or other aspects and utilities of the present general inventive concept can also be achieved by providing a dismounting method of a toner cartridge, the dismounting method including rotating a rotation handle of the toner cartridge mounted to a toner cartridge mounting portion of a developing unit so that a locking blade of the rotation handle is released from a hooking portion of the developing unit, and separating the toner cartridge from the toner cartridge mounting portion of the developing unit.

When the rotation handle rotates approximately 45 degrees, the locking blade of the rotation handle may be released from the hooking portion of developing unit.

When separating the toner cartridge from the toner cartridge mounting portion, the handle locking member of the toner cartridge may be inserted into a fixing groove of the rotation handle.

The foregoing and/or other aspects and utilities of the present general inventive concept can also be achieved by providing a toner cartridge that is detachably disposed at a developing unit of an image forming apparatus, the toner cartridge including a toner tank to store toner, and a rotation handle rotatably disposed at a first end of the toner tank, and having a locking blade formed at an outer circumferential surface thereof, wherein when the rotation handle rotates in predetermined angles, the locking blade is caught on a hooking portion disposed at the developing unit.

The foregoing and/or other aspects and utilities of the present general inventive concept can also be achieved by providing a toner tank of a toner cartridge detachably disposed at a developing unit of an image forming apparatus, the toner tank including a rotation handle rotatably disposed at a first end of the toner tank, and a locking blade disposed at the rotation handle, wherein when the toner tank is mounted to the developing unit and the rotation handle is rotated in a predetermined angle, the locking blade is caught on a hooking portion disposed at the developing unit so that the toner tank is locked to the developing unit.

The foregoing and/or other aspects and utilities of the present general inventive concept can also be achieved by providing a rotation handle of a toner cartridge detachably disposed at a developing unit of an image forming apparatus, the rotation handle including a locking blade disposed at an outer circumferential surface of the rotation handle, wherein the rotation handle rotatably disposed at a first end of the toner tank, and when the toner tank is mounted to the developing unit and the rotation handle is rotated in a predetermined angle, the locking blade is caught on a hooking portion disposed at the developing unit so that the toner cartridge is locked to the developing unit.

The rotation handle may include a fixing groove in which a handle locking member disposed at the toner tank is inserted, wherein when the toner tank is not mounted to the developing unit, the handle locking member is inserted in the fixing groove so that the rotation handle does not rotate, and when the toner tank is mounted to the developing unit, the handle locking member is released from the fixing groove so that the rotation handle rotates.

The foregoing and/or other aspects and utilities of the general inventive concept may also be achieved by providing a toner cartridge locking apparatus usable with an image forming apparatus, the toner cartridge locking apparatus including a toner tank mounted on a developing unit, and the developing unit having at least one of a locking blade and a hooking portion, and a rotation handle disposed on the toner tank, and having an other of the at least one of the locking blade and the hooking portion, wherein the rotation handle is rotated in one direction to engage the locking blade with the hooking portion and in an other direction to disengage the locking blade with the hooking portion.

The foregoing and/or other aspects and utilities of the general inventive concept may also be achieved by providing a locking/unlocking method of a toner cartridge of an image forming apparatus, the method including rotating a rotation handle of the toner cartridge mounted to a toner cartridge mounting portion of a developing unit in one of a dismounting direction and a mounting direction such that disengaging at least one of a locking blade and a hooking portion of the rotation handle from an other of the locking blade and the hooking portion of the developing unit when the rotation handle is rotated in the dismounting direction, and engaging at least one of the locking blade and the hooking portion of the rotation handle with an other of the at least one of the locking blade and the hooking portion of the developing unit when the rotation handle is rotated in the mounting direction.

The foregoing and/or other aspects and utilities of the general inventive concept may also be achieved by providing a computer-readable recording medium having embodied thereon a computer program to execute a method, wherein the method includes rotating a rotation handle of a toner cartridge mounted to a toner cartridge mounting portion of a developing unit in one of a dismounting direction and a mounting direction such that disengaging at least one of a locking blade and a hooking portion of the rotation handle from an other of the locking blade and the hooking portion of the developing unit when a rotation handle is rotated in the disengaging direction; and engaging at least one of a locking blade and hooking portion of the rotation handle with an other of the at least one of the locking blade and the hooking portion of the developing unit when a rotation handle is rotated in the engaging direction.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which:

FIG. 1 is a sectional view schematically illustrating a conventional toner cartridge locking apparatus;

DETAILED DESCRIPTION OF THE PREFERRED EMBODIMENTS

Figure 2:
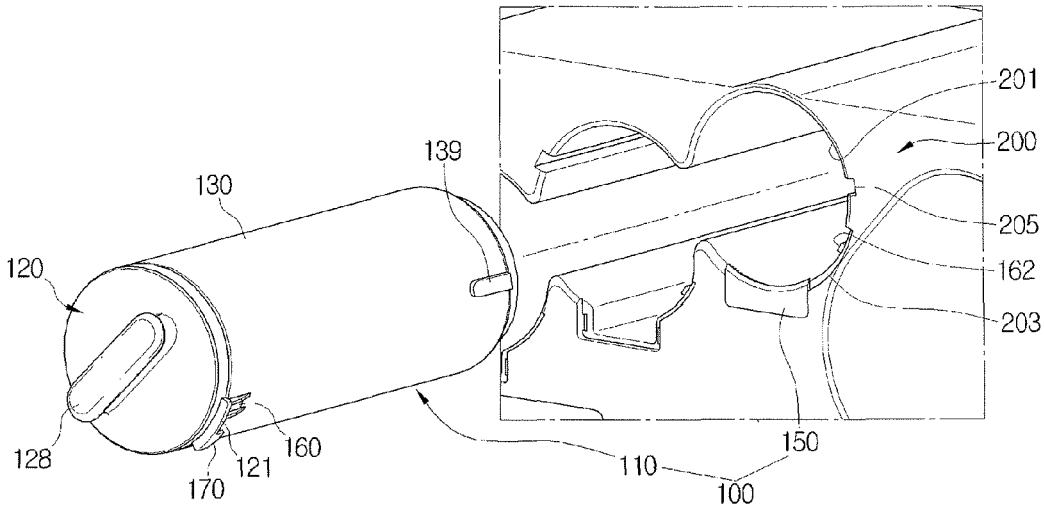
FIG. 2 is a perspective view illustrating a toner cartridge locking apparatus according to an exemplary embodiment of the present general inventive concept.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

The matters defined in the description, such as a detailed construction and elements thereof, are provided to assist in a comprehensive understanding of the present general inventive concept. Thus, it is apparent that the present inventive concept may be carried out without those defined matters. Also, well-known functions or constructions are omitted to provide a clear and concise description of exemplary embodiments herein.

FIG. 2 is an exploded perspective view illustrating a toner cartridge locking apparatus according to an exemplary embodiment of the present general inventive concept.

Referring to FIG. 2, the toner cartridge locking apparatus 100 according to an exemplary embodiment of the present general inventive concept includes a toner cartridge 110 and a hooking portion 150.

The toner cartridge 110 to supply toner to a developing unit 200 of an image forming apparatus 300 (see FIG. 13) is detachably disposed at a toner cartridge mounting portion 201 of the developing unit 200. The toner cartridge 110 includes a toner tank 130, and a rotation handle 120 as illustrated in FIG. 3.

Figure 3:
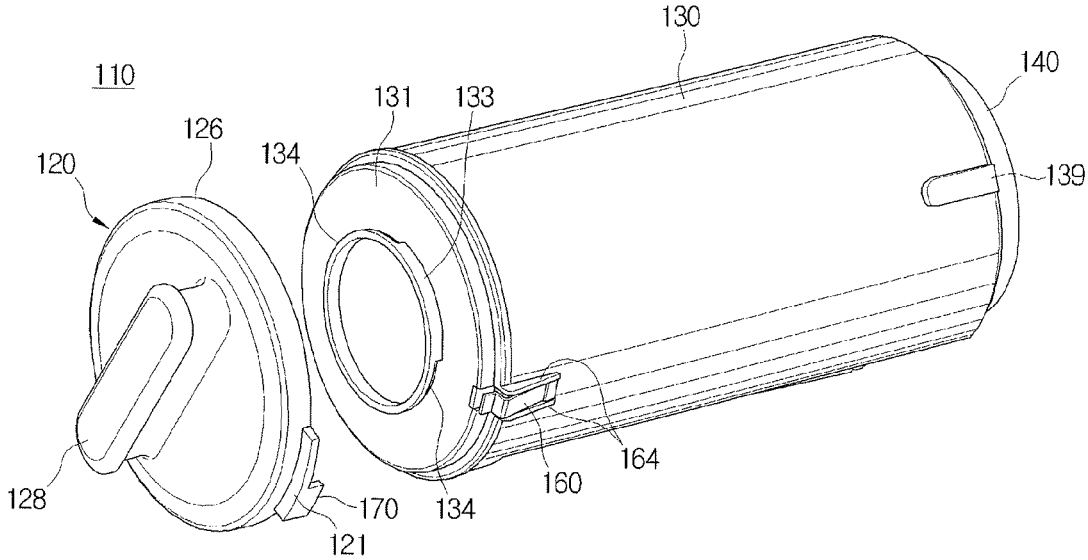
FIG. 3 is an exploded perspective view illustrating a toner cartridge of a toner cartridge locking apparatus according to an exemplary embodiment of the present general inventive concept.
Figure 16:
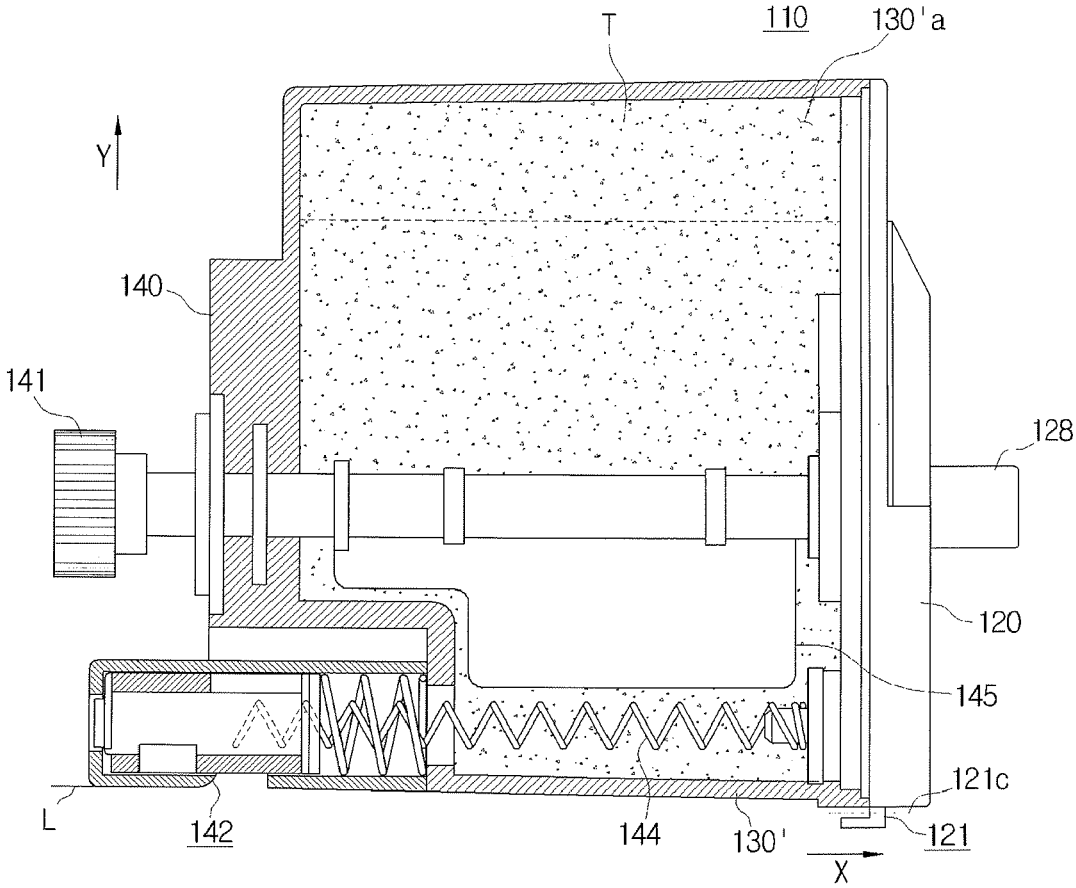
FIG. 16 is a sectional view illustrating the toner cartridge of FIG. 15 taken along a line 16-16 in FIG. 15.

Referring to FIGS. 3 and 16, the toner tank 130 stores a predetermined amount of toner, and is formed substantially in a hollow cylindrical shape with closed opposite ends. A rotation supporting portion 133, to support the rotation handle 120 to rotate, is formed at a first end 131 of the toner tank 130. The rotation supporting portion 133 is formed substantially in a ring shape. At a second end 140 of the toner tank 130 are disposed a gear 141 receiving power from the developing unit 200 and a toner supplying portion 142 that supplies the developing unit 200 with toner in the toner tank 130.

Figure 6:
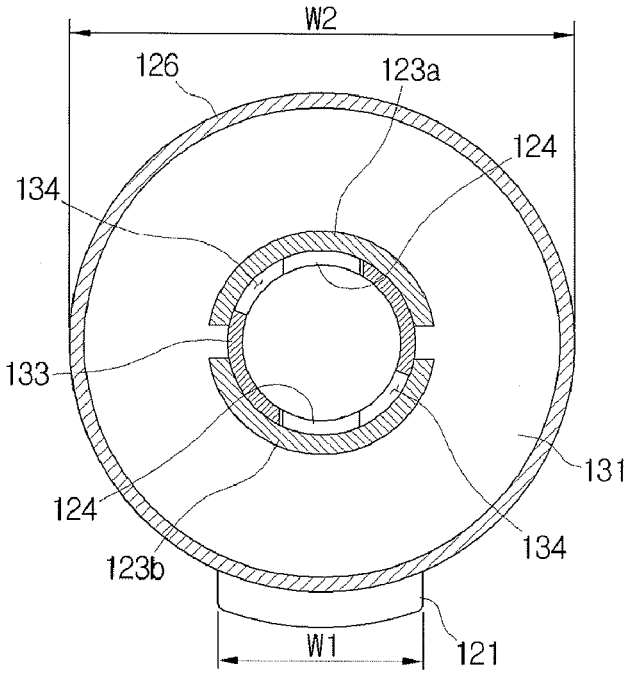
FIG. 6 is a sectional view illustrating a connection of guiding grooves of a rotation supporting portion and guiding projections of a rotating portion of a toner cartridge locking apparatus according to an exemplary embodiment of the present general inventive concept.

The rotation handle 120 is rotatably disposed at the first end 131 of the toner tank 130, and has a locking blade 121 formed at an outer circumferential surface thereof. In this exemplary embodiment, the rotation handle 120 is provided with a rotating portion 123 that is inserted in the rotation supporting portion 133 of the toner tank 130, and rotates with respect to the rotation supporting portion 133 so that the rotation handle 120 can rotate with respect to the toner tank 130. Therefore, the rotating portion 123 (FIG. 4) of the rotation handle 120 is formed substantially in a ring shape corresponding to the rotation supporting portion 133 of the toner tank 130. The rotating portion 123 of the rotation handle 120 may be formed to be inserted into the rotation supporting portion 133 from either an inside or an outside of the rotation supporting portion 133 of the toner tank 130. In this exemplary embodiment, the rotating portion 123 of the rotation handle 120, as illustrated in FIG. 6, is formed substantially in a ring shape that can be inserted into the rotation supporting portion 133 of the toner tank 130 from the outside. Therefore, the rotation handle 120 is coupled to the toner tank 130 and can rotate with respect to the toner tank 130. However, the toner tank 130 may not be formed to rotate even when the rotation handle 120 rotates.

Figure 4:
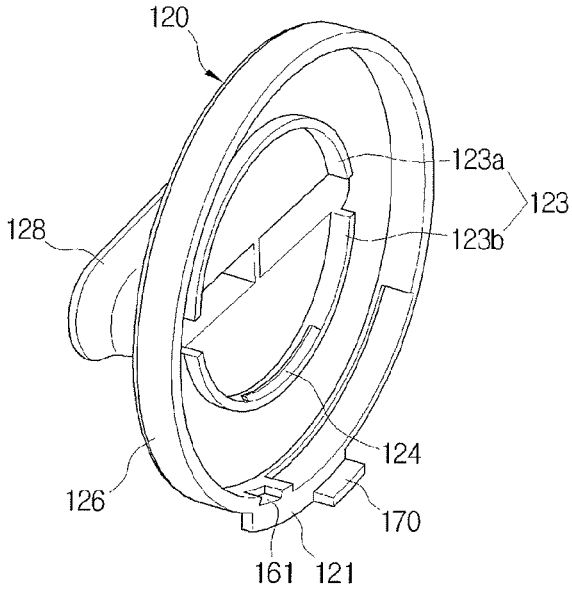
FIG. 4 is a perspective view illustrating a rotation handle of the toner cartridge of FIG. 3.

The ring shaped rotating portion 123 of the rotation handle 120, as illustrated in FIG. 4, may be divided into at least two portions 123*a* and 123*b* in a diameter direction thereof. If the rotating portion 123 is formed in the at least two portions 123*a* and 123*b*, the rotating portion 123 of the rotation handle 120 may be easily coupled to the rotation supporting portion 133 of the toner tank 130 using an elasticity thereof.

Also, the rotation supporting portion 133 of the toner tank 130 may be provided with at least one guiding groove 134 or guiding projection (not illustrated), and the rotating portion 123 of the rotation handle 120 may be provided with at least one guiding projection 124 or guiding groove (not illustrated) that can be inserted into the at least one guiding groove 134 or guiding projection formed at the rotation supporting portion 133 of the toner tank 130 so that the rotation handle 120 can stably rotate with respect to the toner tank 130, and a rotating range of the rotation handle 120 may be limited within a predetermined angle.

In this exemplary embodiment, as illustrated in FIG. 4, the rotating portion 123 of the rotation handle 120 is provided with the guiding projections 124, and the rotation supporting portion 133 of the toner tank 130 is provided with the guiding grooves 134 (FIG. 3) that is formed on an outer circumferential surface thereof, and in which the guiding projections 124 are inserted as illustrated in FIG. 3. When the rotation handle 120 is coupled to the toner tank 130, as illustrated in FIG. 6, the two guiding projections 124 formed on the rotating portion 123 of the rotation handle 120 are inserted into the two guiding grooves 134 formed on the rotation supporting portion 133 of the toner tank 130. In this exemplary embodiment, the guiding grooves 134 of the rotation supporting portion 133 of the toner tank 130 is formed to limit a rotation angle so that the guiding projections 124 of the rotating portion 123 of the rotation handle 120 can rotate within approximately 45 degrees. As a result, the rotation handle 120 can rotate within approximately 45 degrees with respect to the toner tank 130. However, the rotation angle of the rotation handle 120 is only one example, it goes without saying that the rotation angle of the rotation handle 120 may be variously determined. At this time, sizes of the guiding grooves 134 and guiding projections 124 may be adjusted to change the rotation angle of the rotation handle 120.

Alternatively, although not illustrated, the rotating portion 123 of the rotation handle 120 may be provided with guiding grooves, and the rotation supporting portion 133 of the toner tank 130 may be provided with guiding projections that are inserted into and guided by the guiding grooves of the rotating portion 123 of the rotation handle 120.

Referring to FIGS. 2 and 6, the locking blade 121 is formed on the outer circumferential surface of the rotation handle 120 to be caught on the hooking portion 150 disposed at the developing unit 200 when the rotation handle 120 is rotated by a predetermined angle. A width W1 of the locking blade 121 may be formed to be narrower than a width W2 of the rotation handle 120. The locking blade 121 rotates integrally with the rotation handle 120 on a rotation center of the rotation handle 120. To rotate the locking blade 121 a user grips and rotates the rotation handle 120. When the width W2 of the rotation handle 120 is wider than the width W1 of the locking blade 121, the user can rotate the rotation handle 120, that is, the locking blade 121 using a force smaller than the force required to rotate the rotation handle 120 when the width W2 of the rotation handle 120 is the same as or narrower than the width W1 of the locking blade 121.

Figure 19:
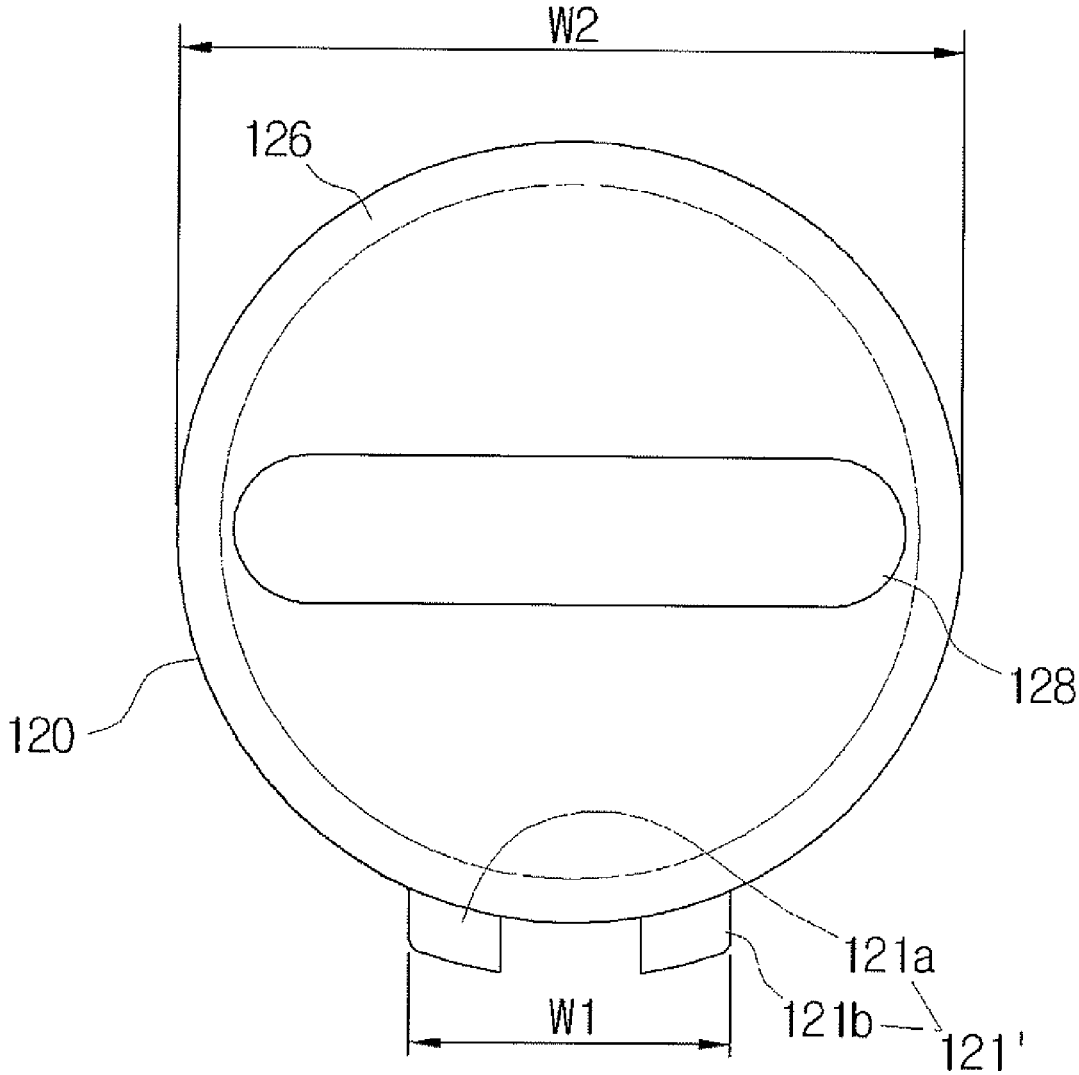
FIG. 19 is a front view illustrating a rotation handle with a locking blade according to another exemplary embodiment of the present general inventive concept.

Here, the width W1 of the locking blade 121 refers to a length of the locking blade 121 in a circumferential direction of the rotation handle 120 as illustrated in FIG. 6. Referring to FIG. 19, when a locking blade 121' of the rotation handle 120 is formed in a plurality of protrusions 121*a* and 121*b*, a width W1 of the locking blade 121' refers to a distance between outer sides of the two protrusions 121*a* and 121*b* among the plurality of protrusions that is farthest apart. For example, when the locking blade 121' is formed in two protrusions 121*a* and 121*b* as illustrated in FIG. 19, the width W1 of the locking blade 121' refers to the distance between outer sides of the two protrusions 121*a* and 121*b*. Also, the width W2 of the rotation handle 120 refers to a length of a longest portion of a section of the rotation handle 120. When the section of the rotation handle 120 is a circle as illustrated in FIGS. 6 and 19, the width W2 of the rotation handle 120 refers to a diameter of the rotation handle 120.

Figure 17:
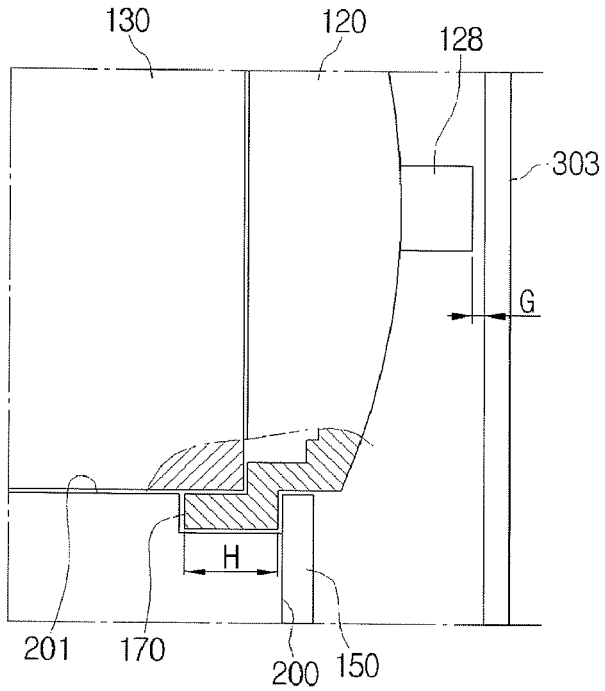
FIG. 17 is a partial sectional view illustrating a toner cartridge according to an exemplary embodiment of the present general inventive concept completely locked to a toner cartridge mounting portion.

Referring to FIGS. 6 and 17, an inserting projection 170 may be formed on a bottom surface of the locking blade 121. When the toner cartridge 110 (FIG. 2) is incompletely inserted into the toner cartridge mounting portion 201, the inserting projection 170 may locate above the hooking portion 150. In this exemplary embodiment, the inserting projection 170 is formed on the bottom surface of the locking blade 121 parallel with a side surface of the toner tank 130, and may have a width half the width W1 of the locking blade 121. When the toner cartridge 110 (FIG. 2) is completely mounted to the toner cartridge mounting portion 201 of the developing unit 200, a height H of the inserting projection 170 may be larger than a gap G between a handle 128 of the toner cartridge 110 and a front cover 303 of the image forming apparatus 300 (FIG. 13) covering the developing unit 200 (see FIG. 17). For example, when the gap G between the handle 128 of the toner cartridge 110 and the front cover 303 of the image forming apparatus 300 covering the developing unit 200 is approximately 3 mm, the height H of the inserting projection 170 may be approximately 5 mm.

As illustrated in FIGS. 3 and 4, a skirt 126 may be formed at the outer circumference of the rotation handle 120 to enclose the rotating portion 123 and to have the same center as that of the rotating portion 123. The skirt 126 prevents the rotating portion 123 of the rotation handle 120 coupled to the rotation supporting portion 133 of the toner tank 130 from being seen from the outside. The locking blade 121 can be disposed on the skirt 126.

Also, the rotation handle 120 may have the handle 128 as illustrated in FIG. 3 so that the user can easily rotate the rotation handle 120. The handle 128, as illustrated in FIG. 4, is formed opposite a side of the rotation handle 120 on which the rotating portion 123 is formed. When the locking blade 121 is inserted into the hooking portion 150 of the developing unit 200, the handle 128 of the rotation handle 120 may maintain a horizontal position. When the locking blade 121 is released from the hooking portion 150 in order to dismount the toner cartridge 110, the handle 128 may be in an inclined position.

Figure 5:
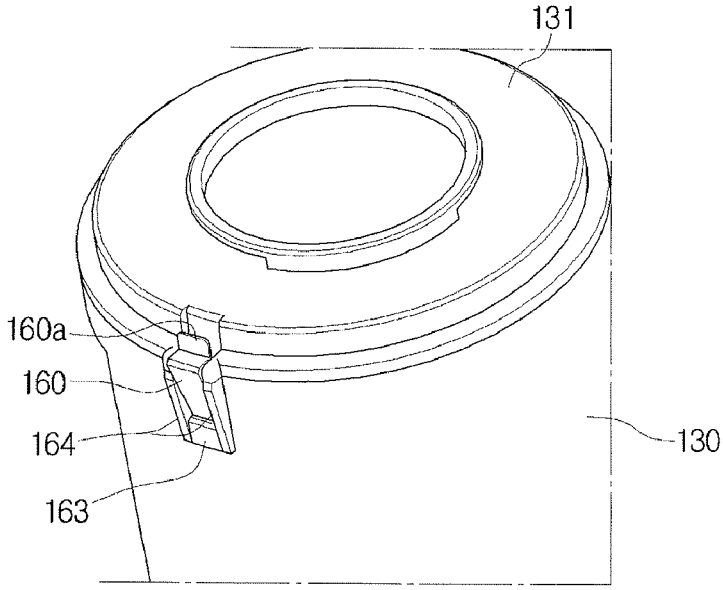
FIG. 5 is a partial perspective view illustrating an embodiment of a handle locking member of the toner cartridge of FIG. 3.
Figure 7:
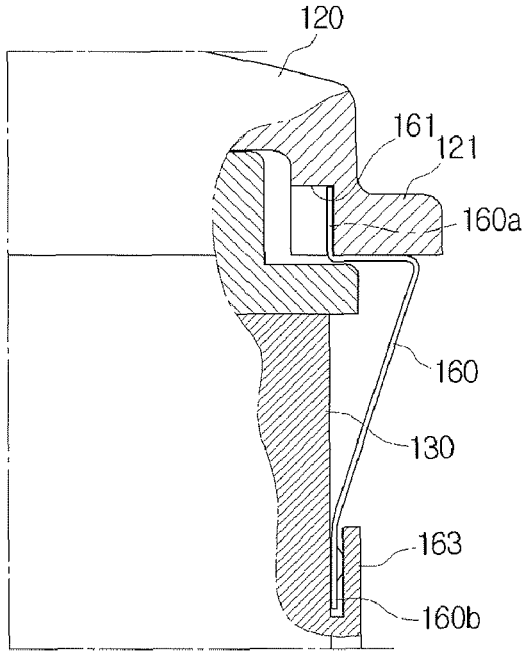
FIG. 7 is a partial sectional view illustrating a rotation handle locked by a handle locking member of a toner cartridge locking apparatus according to an exemplary embodiment of the present general inventive concept.

Furthermore, the toner cartridge 110 may have a handle locking member 160 to prevent the rotation handle 120 from rotating. The handle locking member 160, as illustrated in FIGS. 3 and 5, is disposed near the rotation handle 120 at a side surface of the toner tank 130 of the toner cartridge 110. Referring to FIG. 7, one end 160*b* of the handle locking member 160 forms a fixing end that is fixed to the toner tank 130, and an other end 160*a* of the handle locking member 160 forms a free end that is biased to separate from the side surface of the toner tank 130. Therefore, when the handle locking member 160 receives a pressing force, the free end 160*a* comes close to the toner tank 130. When the pressing force is removed from the handle locking member 160, the free end 160*a* becomes more distant from the toner tank 130. In this exemplary embodiment, the handle locking member 160 is formed of a leaf spring, and the free end 160*a* thereof is bent to enter a fixing groove 161 of the rotation handle 120. The fixing end 160*b* of the handle locking member 160 is fixed to a fixing portion 163 formed at the side surface of the toner tank 130. Also, a pair of protecting protrusions 164 (FIG. 5) may be formed at both sides of the handle locking member 160 on the side surface of the toner tank 130. That is, the handle locking member 160 may be disposed between the pair of protecting protrusions 164. The pair of protecting protrusions 164 blocks a space between the handle locking member 160 and the side surface of the toner tank 130 at both sides of the handle locking member 160, thereby allowing the handle locking member 160 to smoothly operate.

Figure 8:
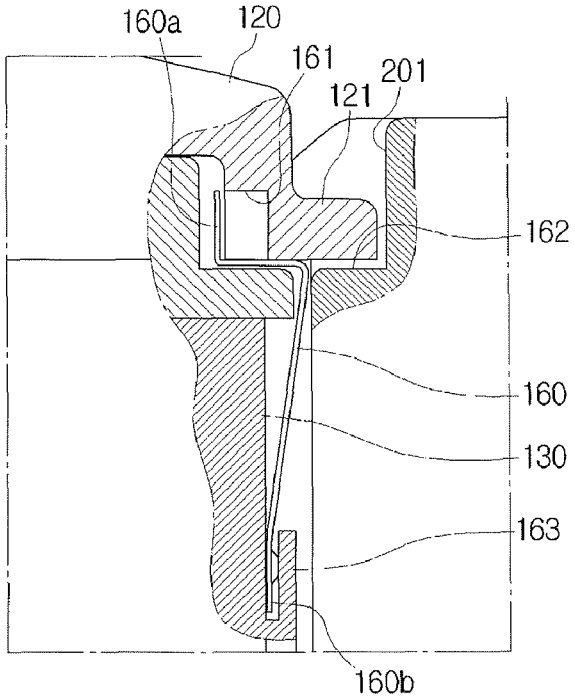
FIG. 8 is a partial sectional view illustrating a rotation handle released from a handle locking member of a toner cartridge locking apparatus according to an exemplary embodiment of the present general inventive concept.

Referring to FIGS. 4 and 8, the fixing groove 161 into which the handle locking member 160 is inserted may be formed at an inner surface of the skirt 126 of the rotation handle 120. The fixing groove 161 may be formed so that when the handle 128 of the rotation handle 120 is inclined, the free end 160*a* of the handle locking member 160 is inserted into the fixing groove 161. In this exemplary embodiment, when the handle 128 of the rotation handle 120 inclines in approximately 45 degrees, the free end 160*a* of the handle locking member 160 is inserted into the fixing groove 161. Also, when a pressing projection 162 of the toner cartridge mounting portion 201 presses the handle locking member 160, the free end 160*a* of the handle locking member 160 is released from the fixing groove 161 as illustrated in FIG. 8. When the pressing projection 162 does not press the handle locking member 160, the free end 160*a* of the handle locking member 160 is inserted in the fixing groove 161 as illustrated in FIG. 7. When the free end 160*a* of the handle locking member 160 is inserted in the fixing groove 161 of the rotation handle 120, the rotation handle 120 cannot rotate with respect to the toner tank 130.

Referring to FIG. 2, a reference projection 139 may be formed on the side surface of the toner tank 130 near the second end 140 thereof at which the rotation handle 120 is not disposed. Also, a reference groove 205 corresponding to the reference projection 139 may be formed in the toner cartridge mounting portion 201 of the developing unit 200. Therefore, when mounting the toner cartridge 110 to the toner cartridge mounting portion 201, the user inserts the reference projection 139 into the reference groove 205, and so, pushes the toner cartridge 110 into the toner cartridge mounting portion 201. When the image forming apparatus 300 (FIG. 13) uses a plurality of toner cartridges 110 for different colors, the reference projection 139 of each of the plurality of toner cartridges 110 may be formed to have a different phase according to the color of toner. Therefore, the user is prevented from mounting the toner cartridge 110 for a specific color toner to the toner cartridge mounting portion 201 for a different color toner cartridge 110.

The hooking portion 150 is disposed at the developing unit 200 to which the toner cartridge 110 is mounted. The developing unit 200 is provided with at least one toner cartridge mounting portion 201 to which the toner cartridge 110 is mounted. The hooking portion 150 is disposed at an entrance of the toner cartridge mounting portion 201 formed at the developing unit 200, and is formed to receive the locking blade 121 of the rotation handle 120. Therefore, when the locking blade 121 of the rotation handle 120 is inserted into the hooking portion 150, the toner cartridge 110 is locked to the developing unit 200. The hooking portion 150 may be formed in a separate piece and disposed at the developing unit 200. Alternatively, the hooking portion 150 may be formed integrally with the toner cartridge mounting portion 201 of the developing unit 200.

The toner cartridge mounting portion 201 is formed substantially in a circular hole corresponding to the toner tank 130 of the toner cartridge 110, and is provided with a toner receiving portion (not illustrated) that is formed at an inner surface thereof to correspond to the toner supplying portion 142 (FIG. 16) of the toner cartridge 110. The toner receiving portion is in fluid communication with a developing roller 220 (see FIG. 12) so that toner is supplied from the toner cartridge 110 to the developing roller 220. A locking blade guiding groove 203 may be formed at an entrance of the toner cartridge mounting portion 201 to prevent the locking blade 121 of the rotation handle 120 from projecting outwardly from the developing unit 200 and guiding the rotation of the locking blade 121. If the locking blade 121 has an inserting projection 170, the locking blade guiding groove 203 is formed to receive the inserting projection 170. The hooking portion 150 may be disposed in front of the locking blade guiding groove 203 to cover some portion of the locking blade guiding groove 203. When the rotation handle 120 is rotated in a first direction, the locking blade 121 is inserted into a gap between the hooking portion 150 and the locking blade guiding groove 203 so that the toner cartridge 110 is locked to the toner cartridge mounting portion 201 of the developing unit 200. Also, when rotating the rotation handle 120 in an opposite direction, the locking blade 121 is released from the hooking portion 150 so that the toner cartridge 110 becomes a state capable of being separated from the toner cartridge mounting portion 201 of the developing unit 200.

Furthermore, referring to FIGS. 2 and 8, the pressing projection 162 may be disposed at the entrance of the toner cartridge mounting portion 201 to press the handle locking member 160 of the toner cartridge 110 (FIG. 2). Therefore, when the toner cartridge 110 is mounted to the toner cartridge mounting portion 201, as illustrated in FIG. 8, the pressing projection 162 presses the handle locking member 160 so that the free end 160*a* of the handle locking member 160 is released from the fixing groove 161 formed at the inner surface of the rotation handle 120. Then, the rotation handle 120 can freely rotate with respect to the toner tank 130.

Figure 9:
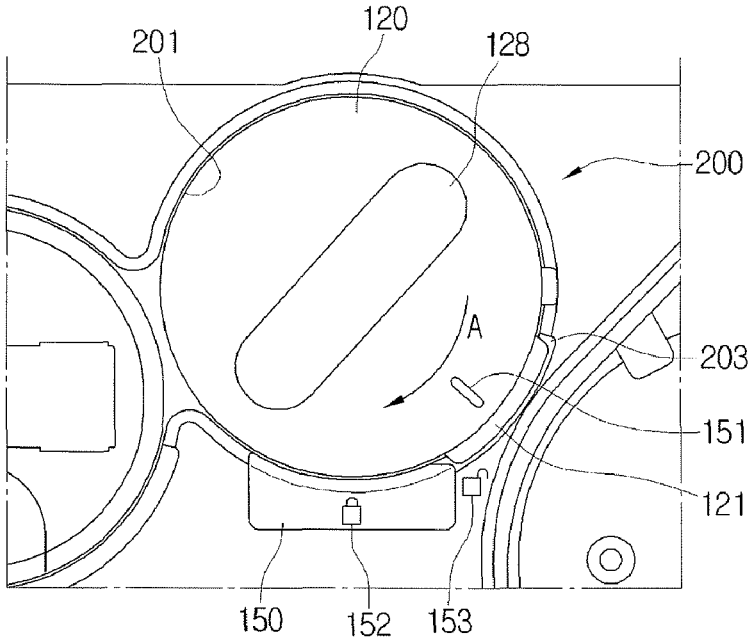
FIG. 9 is a front view illustrating an unlocked toner cartridge locking apparatus according to an exemplary embodiment of the present general inventive concept.
Figure 10:
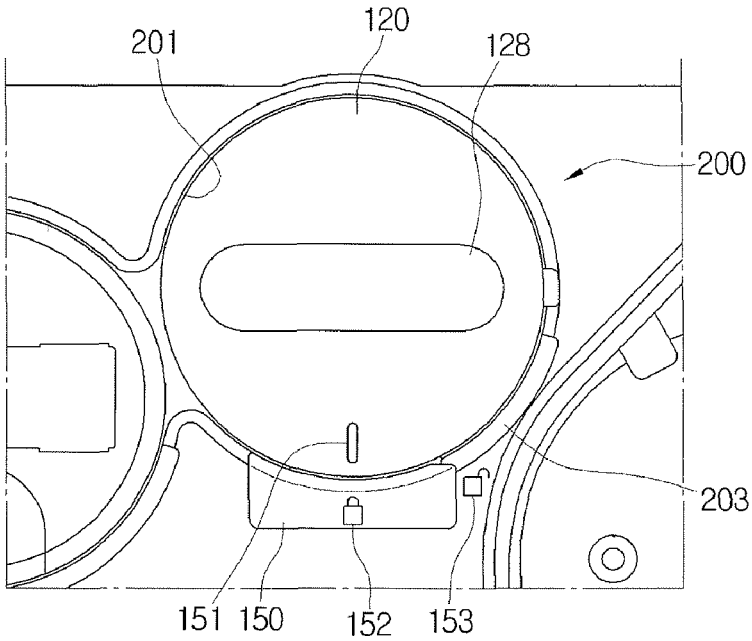
FIG. 10 is a front view illustrating a locked toner cartridge locking apparatus according to an exemplary embodiment of the present general inventive concept.

As illustrated in FIGS. 9 and 10, marks, which represent a locked position in which the toner cartridge 110 (FIG. 2) is locked to the toner cartridge mounting portion 201 and an unlocked position in which the toner cartridge 110 can be dismounted from the toner cartridge mounting portion 201, may be disposed on the hooking portion 150 and the developing unit 200. Referring to FIGS. 9 and 10, a locked lock mark 152 represents the locked position in which the toner cartridge 110 is locked to the toner cartridge mounting portion 201 by the hooking portion 150. An unlocked lock mark 153 represents the unlocked position in which the toner cartridge 110 can be separated from the toner cartridge mounting portion 201. A reference mark 151 is disposed at the rotation handle 120 of the toner cartridge 110. When the reference mark 151 of the rotation handle 120 points at the locked lock mark 152, the toner cartridge 110 is locked to the toner cartridge mounting portion 201.

Hereinafter, operation of the toner cartridge locking apparatus 100 according to an exemplary embodiment of the present general inventive concept will be explained with reference to FIGS. 2, 9, and 10. At this time, a mounting method and dismounting method of the toner cartridge 110 will be explained together.

First, when mounting the toner cartridge 110 to the developing unit 200 of the image forming apparatus 300 (see FIG. 13), the user grips the rotation handle 120 and toner tank 130 of the toner cartridge 110, and so, inserts the toner tank 130 into the toner cartridge mounting portion 201 of the developing unit 200. At this time, a direction of the toner cartridge 110 may be adjusted so that the locking blade 121 of the rotation handle 120 of the toner cartridge 110 is not interfered with by the hooking portion 150 and is inserted into the locking blade guiding groove 203. When the toner cartridge 110 is provided with the reference projection 139 and the toner cartridge mounting portion 201 is provided with reference groove 205 as illustrated in this exemplary embodiment, the reference projection 139 is aligned to the reference groove 205, and then, the toner cartridge 110 is inserted into the toner cartridge mounting portion 201. Also, when the toner cartridge 110 is provided with the handle locking member 160, the free end 160*a* of the handle locking member 160 is inserted in the fixing groove 161 of the rotation handle 120 so that the rotation handle 120 does not rotate and is fixed with respect to the toner tank 130. Therefore, when mounting the toner cartridge 110, the rotation handle 120 does not rotate with reference to the toner tank 130.

When the locking blade 121 of the rotation handle 120 of the toner cartridge 110 is received in the locking blade guiding groove 203 of the developing unit 200, the pressing projection 162 formed at the toner cartridge mounting portion 201 presses the handle locking member 160 of the toner cartridge 110. When the handle locking member 160 is pressed, as illustrated in FIG. 8, the free end 160*a* of the handle locking member 160 is released from the fixing groove 161 of the rotation handle 120 to enable the rotation handle 120 to rotate. After the toner cartridge 110 is mounted to the toner cartridge mounting portion 201, the user rotates the rotation handle 120 in approximately 45 degrees in a clockwise direction as arrow A illustrated in FIG. 9. So, the locking blade 121 of the rotation handle 120 is inserted into the hooking portion 150, and the handle 128 of the rotation handle 120 becomes horizontal as illustrated in FIG. 10.

In the toner cartridge 110 according to this exemplary embodiment, the guiding projections 124 formed at the rotating portion 123 of the rotation handle 120, as illustrated in FIG. 6, is guided by guiding grooves 134 formed at the rotation supporting portion 133 of the toner tank 130 so that the rotation handle 120 can stably rotate with respect to the toner tank 130 only within an approximately 45 degrees range. After the locking blade 121 of the rotation handle 120 has been inserted in the hooking portion 150, when the handle 128 of the toner cartridge 110 is pulled, the locking blade 121 of the rotation handle 120 is interfered with by the hooking portion 150 so that the toner cartridge 110 is not separated from the toner cartridge mounting portion 201. As a result, the toner cartridge 110 is locked to the developing unit 200.

When separating the toner cartridge 110 from the developing unit 200 of the image forming apparatus 300, the user grips the handle 128 of the rotation handle 120, and so, rotates the rotation handle 120 in approximately 45 degrees in a counterclockwise direction so that the locking blade 121 of the rotation handle 120 is completely released from the hooking portion 150 as illustrated in FIG. 9. When the rotation handle 120 rotates in approximately 45 degrees, the fixing groove 161 formed at the inner surface of the rotation handle 120 is positioned in front of the free end 160*a* of the handle locking member 160. In this state, when pulling the handle 128 of the rotation handle 120, the locking blade 121 of the rotation handle 120 is not interfered with the hooking portion 150 so that the toner cartridge 110 is separated from the toner cartridge mounting portion 201. When the toner cartridge 110 comes out off the toner cartridge mounting portion 201 by a predetermined length, the handle locking member 160 is released from the pressing projection 162. When the handle locking member 160 is released from the pressing projection 162, the free end 160*a* of the handle locking member 160 enters, by a recovering force of the handle locking member 160, the fixing groove 161 of the rotation handle 120 to fix the rotation handle 120. As a result, the rotation handle 120 cannot rotate with respect to the toner tank 130.

With the toner cartridge locking apparatus 100 according to an exemplary embodiment of the present general inventive concept, the rotation of the rotation handle 120 rotatably disposed at the toner tank 130 allows the toner cartridge 110 to become either a locked state in which the toner cartridge 110 is locked to the developing unit 200 or an unlocked state in which the toner cartridge 110 can be separated from the developing unit 200. Therefore, the toner cartridge 110 is mounted to and dismounted from the developing unit 200 in an easy manner.

Furthermore, if the toner cartridge 110 is provided with the handle locking member 160, the rotation handle 120 can rotate only when the toner cartridge 110 is mounted to the toner cartridge mounting portion 201. Therefore, when mounting or dismounting the toner cartridge 110, the rotation handle 120 does not rotate from side to side so that mounting and dismounting the toner cartridge 110 in an easy manner.

Hereinafter, the image forming apparatus 300 having the toner cartridge locking apparatus 100 according to an exemplary embodiment of the present general inventive concept will be explained with reference to FIGS. 11 and 12.

Figure 11:
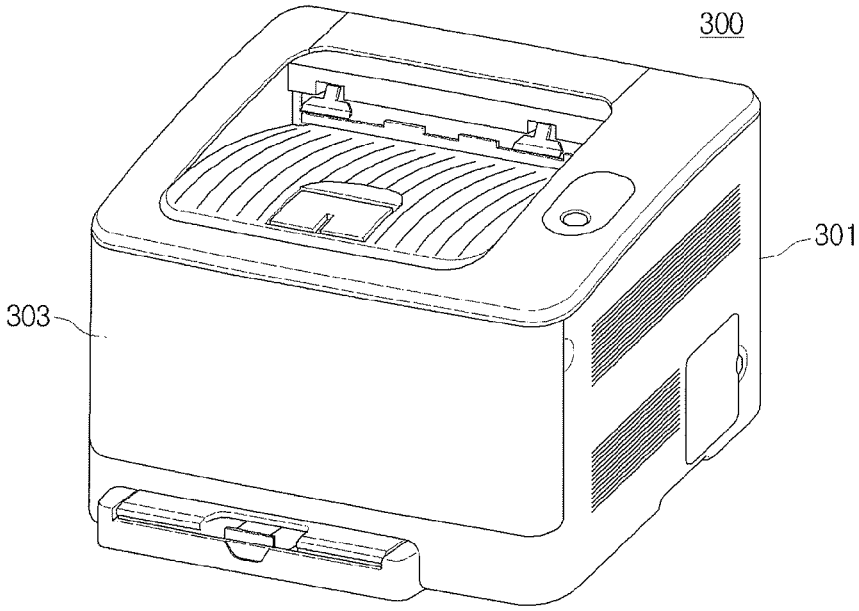
FIG. 11 is a perspective view illustrating an image forming apparatus having a toner cartridge locking apparatus according to an exemplary embodiment of the present general inventive concept.
Figure 12:
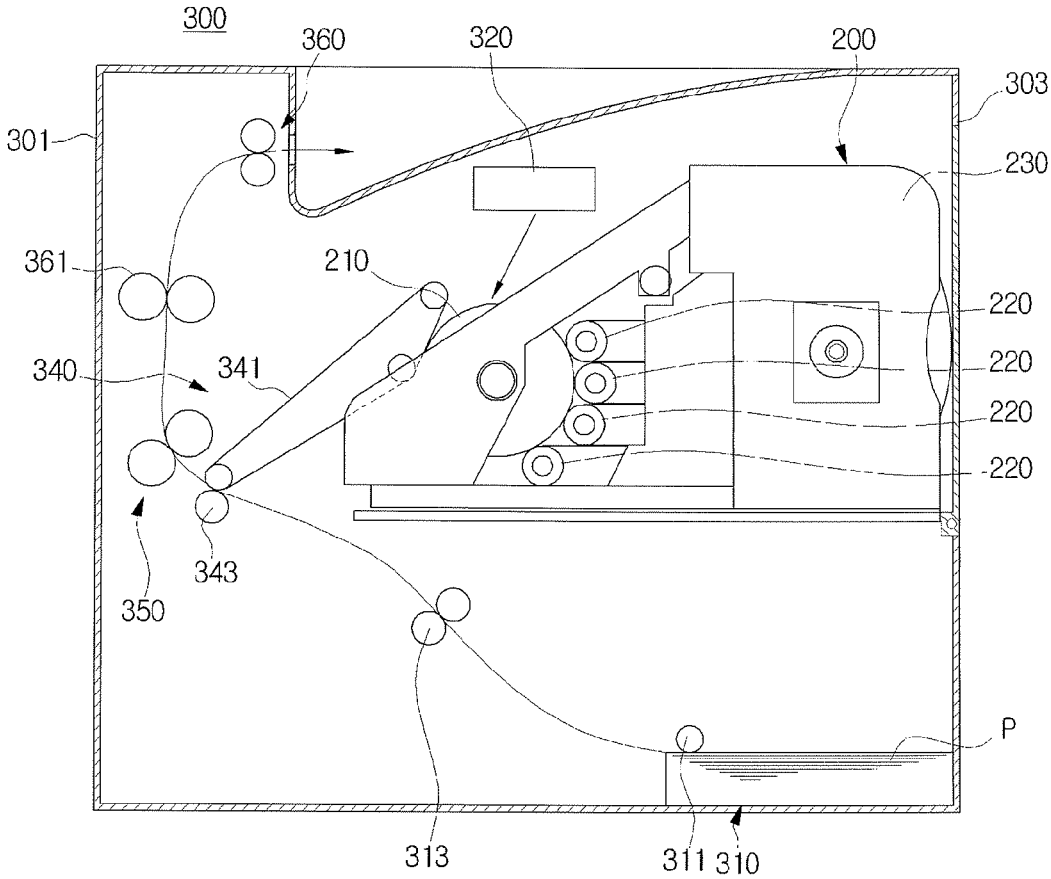
FIG. 12 is a sectional view schematically illustrating the image forming apparatus of FIG. 11.

Referring to FIGS. 11 and 12, the image forming apparatus 300 having the toner cartridge locking apparatus 100 (FIG. 2) according to an exemplary embodiment of the present general inventive concept includes a main body 301, a printing medium feeding unit 310, an exposure unit 320, the developing unit 200, a transferring unit 340, a fusing unit 350, and a discharging unit 360.

The main body 301 forms an appearance of the image forming apparatus 300, and supports the printing medium feeding unit 310, the exposure unit 320, the developing unit 200, the transferring unit 340, the fusing unit 350, and the discharging unit 360. A front cover 303 is hinge connected to a front surface of the main body 301 to open or close selectively the front surface at which the toner cartridge mounting portions 201 are formed.

The printing medium feeding unit 310 stores a predetermined amount of printing media P, and picks up the printing media P one by one, so feeds it to the transferring unit 340. The printing medium feeding unit 310 includes a pickup roller 311 to pick up the printing media P and a conveying roller 313 to convey the picked up printing media P.

The exposure unit 320 emits a laser beam corresponding to printing data to form predetermined electrostatic latent images on a photosensitive medium 210 of the developing unit 200.

The developing unit 200 develops the electrostatic latent images of the photosensitive medium 210 into toner images, and includes the photosensitive medium 210, four developing rollers 220 disposed around the photosensitive medium 210, and a toner supplying unit 230 to supply the four developing rollers 220 with toner.

The photosensitive medium 210 is rotatably disposed in the developing unit 200. The laser beam emitted from the exposure unit 320 forms the electrostatic latent images on a surface of the photosensitive medium 210. Each of the four developing rollers 220 supplies the electrostatic latent images formed on the photosensitive medium 210 with black, cyan, magenta, and yellow toners to form color images. The toner supplying unit 230 supplies different color toner to each of the four developing rollers 220, and is provided with four toner cartridge mounting portions 201 in which the four toner cartridges 110 are mounted.

Figure 13:
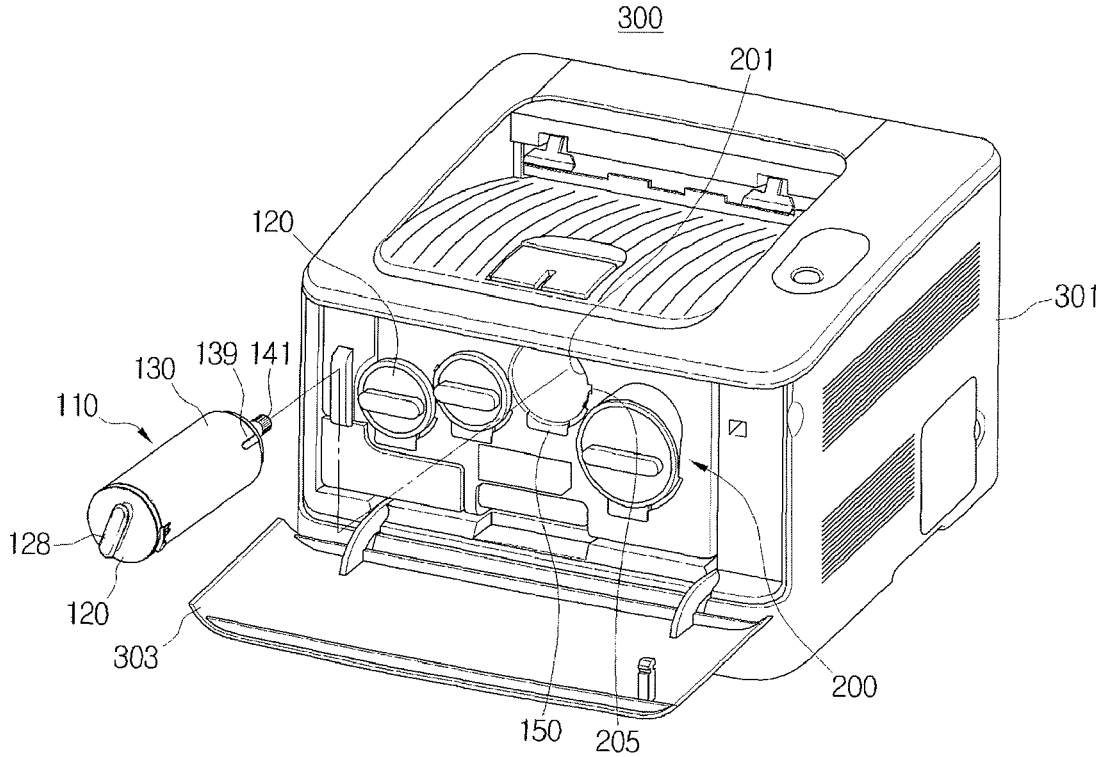
FIG. 13 is a perspective view illustrating an embodiment of a toner cartridge that is going to be mounted to the image forming apparatus of FIG. 11.
Figure 14:
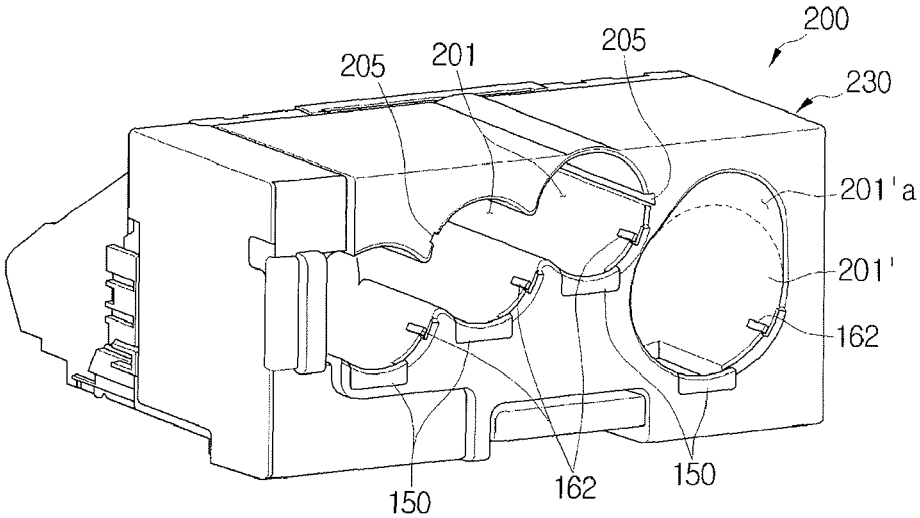
FIG. 14 is a perspective view illustrating a developing unit to which no toner cartridge is mounted according to an embodiment of the present general inventive concept.
Figure 15:
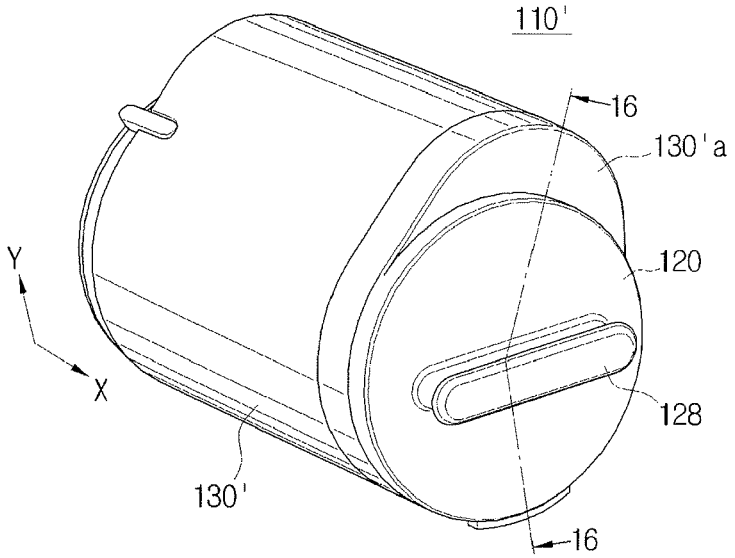
FIG. 15 is a perspective view illustrating a noncircular toner cartridge to mount to the developing unit of FIG. 14.

FIG. 13 is a perspective view illustrating the image forming apparatus 300 with the opened front cover 303 of the main body 301 to disclose the toner cartridge mounting portions 201 formed in the developing unit 200 and the toner cartridges 110 (FIG. 2) mounted to the toner cartridge mounting portions 201 (FIG. 2). FIG. 14 is a perspective view illustrating the developing unit 200 without toner cartridges 110 and 110' (FIG. 15).

Referring to FIG. 14, the developing unit 200 is provided with four toner cartridge mounting portions 201 and 201'. The three toner cartridge mounting portions 201 are formed substantially in a circular hole corresponding to the inserting toner cartridge 110 (FIG. 2). Also, one toner cartridge mounting portion 201' is formed in a noncircular hole. The noncircular toner cartridge mounting portion 201' may be provided with an extension groove 201'*a* to extend to a portion in which the three toner cartridge mounting portions 201 are not formed to maximize an amount of toner that can be stored in the toner cartridge 110' (FIG. 15) inserted in the noncircular toner cartridge mounting portion 201'. The above-described configuration allows toner capacity of the toner cartridge 110' to be increased without increasing a size of the image forming apparatus 300.

The toner tank of the toner cartridge 110' mounted in the noncircular toner cartridge mounting portion 201' is formed to have a noncircular section corresponding to the noncircular toner cartridge mounting portion 201'. An example of the noncircular toner cartridge 110' is illustrated in FIGS. 15 and 16. Referring to FIGS. 15 and 16, the toner tank of the noncircular toner cartridge 110' has an extension portion 130'*a* extending upwardly from a cylindrical body 130'. The extension portion 130'*a* of the noncircular toner cartridge 110' is formed in a shape corresponding to the extension groove 201'*a* of the noncircular toner cartridge mounting portion 201' (FIG. 14). Therefore, the noncircular toner cartridge 110' may store a greater amount of toner corresponding to a size of the extension portion 130'*a* as compared with the toner tank 130 of the circular toner cartridge 110. An agitator 145 to agitate the stored toner T and a toner-conveying member 144 conveying the toner T to the toner supplying portion 142 are disposed inside the noncircular toner cartridge 110'. The agitator 145 and toner-conveying member 144 receives power from the gear 141 disposed outside the toner cartridge 110', thereby rotating. Because the image forming apparatus 300 (FIG. 13) generally uses more black toner than other color toners, in this exemplary embodiment, the black toner cartridge 110' to store black toner is formed as the noncircular toner cartridge, and the other three color toner cartridges 110 are formed as the circular toner cartridge having a same size circular section.

Referring to FIGS. 12 and 14, the toner receiving portion (not illustrated) is formed inside the toner cartridge mounting portion 201 to receive the toner discharged from the toner cartridge 110. The toner entering the toner receiving portion is supplied to the developing roller 220 via the toner supplying unit 230. Therefore, in the noncircular toner cartridge mounting portion 201', the extension groove 201'*a* may be formed opposite the toner receiving portion.

Referring to FIGS. 14 and 16, the developing unit 200 is provided with four toner cartridge locking apparatuses 100 to lock the four toner cartridges 110 and 110'. That is, the hooking portion 150 is disposed at the entrance of each of the toner cartridge mounting portions 201 and 201', and the locking blade 121 is disposed at the rotation handle 120 of the toner cartridge 110 and 110'. Therefore, after the toner cartridge 110 and 110' is inserted into the toner cartridge mounting portion 201 and 201', the rotation handle 120 is rotated so that the locking blade 121 is inserted into the hooking portion 150. So the toner cartridge 110 and 110' is locked to the developing unit 200.

Referring to FIGS. 16 and 17, when the locking blade 121 of the rotation handle 120 is inserted in the hooking portion 150 so that the toner cartridge 110' (FIG. 15), that is, the cylindrical body 130' is locked to the developing unit 200, the locking blade 121 may be formed to locate at a level similar to that L of the toner supplying portion 142 of the cylindrical body 130' opposite the toner supplying portion 142 in a lengthwise direction of the cylindrical body 130' (X direction). That is, as illustrated in FIG. 16, a center line 121*c* of the locking blade 121 may locate at the same level as or beneath the level L of the toner supplying portion 142. If the locking blade 121 is formed so that when the cylindrical body 130' is mounted to the developing unit 200, the locking blade 121 locates at the level similar to the level L of the toner supplying portion 142, the toner cartridge locking apparatus 100 can effectively prevent the cylindrical body 130' from moving in the X direction by the force generating as the cylindrical body 130' of the toner cartridge 110' supplies the developing unit 200 with the toner via the toner supplying portion 142. Also, the locking blade 121 can prevent the toner from leaking from a gap between the cylindrical body 130' and the toner cartridge mounting portion 201' because of deformation of the toner supplying portion 142 of the cylindrical body 130' caused by a long term usage thereof.

Also, the cylindrical body 130' of the toner cartridge 110' to store the greatest amount of toner may include the extension portion 130'*a* as described above. The extension portion 130'*a* of the cylindrical body 130' is, as illustrated in FIG. 16, formed substantially opposite the toner supplying portion 142 in a height direction of the toner cartridge 110' (Y direction). The extension portion 130'*a* may be formed substantially in a vertical direction so that the toner can be smoothly supplied to the toner supplying portion 142 and the toner-conveying member 144 of the toner cartridge 110'. In this exemplary embodiment, as illustrated in FIG. 15, the extension portion 130'*a* is formed at an upper right portion of the toner cartridge 110'.

Furthermore, the extension portion 130'*a* formed at the toner tank 130' can reduce force per unit area that the cylindrical body 130' receives in the Y direction due to the force generating as the cylindrical body 130' of the toner cartridge 110' supplies the developing unit 200 with the toner. Specially, when the extension portion 130'*a* of the cylindrical body 130' is formed to have a section similar to a portion of an ellipse, an area of the cylindrical body 130' contacting the toner cartridge mounting portion 201' may be larger than when the toner tank 130 has a circular section. Therefore, the force per unit area that the cylindrical body 130' receives in the Y direction when supplying the toner may be decreased as compared to the toner tank 130 having the circular section. If the force per unit area that the cylindrical body 130' receives in the Y direction is reduced, lifespan of the cylindrical body 130' and the developing unit 200 may be extended.

Particularly, because the image forming apparatus 300 using four color toners uses more black toner than the other color toners, the toner cartridge 110' for the black toner supplies the toner more frequently and for a time longer than the other toner cartridges 110 for different color toners, thereby receiving a larger force than the toner cartridges 110 for different color toners. If the toner cartridge 110' for the black toner is formed to have the extension portion 130'*a*, the force per unit area that applies to the toner cartridge 110' in the vertical direction (Y direction) may be decreased. Therefore, deformation and/or a shortening life span of the toner cartridge 110' for the black toner may be prevented.

In the above explanation, the toner cartridge 110' for the black toner of the developing unit 200 is formed in the noncircular shape; however, this should not be considered as limiting. Alternatively, the toner cartridge 110' for the black toner may be formed in a circular cartridge.

Referring to FIG. 12, the transferring unit 340 allows the toner images formed on the photosensitive medium 210 to be transferred onto the printing media P, and includes a transferring belt 341 onto which the toner images on the photosensitive medium 210 is first transferred, and a transfer roller 343 to transfer the toner images transferred on the transferring belt 341 onto the printing media P.

The fusing unit 350 applies high heat and pressure to the toner images transferred by the transferring unit 340, thereby fusing the toner images on the printing media P. The fusing unit 350 includes a pressure roller and a heat roller.

The discharging unit 360 discharges the printing media P having the toner images fused thereon by the fusing unit 350 outside the image forming apparatus 300. A discharge conveying roller 361 is disposed between the discharging unit 360 and the fusing unit 350 to guide movement of the printing media P.

When receiving a printing order, the image forming apparatus 300 having the above-described structure controls the exposure unit 320 to emit a laser beam corresponding to printing data. The laser beam emitting from the exposure unit 320 forms electrostatic latent images corresponding to the printing data on the photosensitive medium 210 of the developing unit 200. The four developing rollers 220 supply the photosensitive medium 210 with black, cyan, magenta, and yellow toners, respectively, thereby developing the electrostatic latent images into toner images. The toner images formed on the photosensitive medium 210 are transferred onto the transferring belt 341 of the transferring unit 340.

Furthermore, when receiving the printing order, the image forming apparatus 300 controls the printing medium feeding unit 310 to pick up a printing media P, and so, feeds the picked up printing media P to the transferring unit 340.

The transfer roller 343 allows the toner images transferred onto the transferring belt 341 to be transferred onto the printing media P entering between the transferring belt 341 and the transfer roller 343 from the printing medium feeding unit 310. When the printing media P having the toner images transferred thereon passes through the fusing unit 350, the toner images are fused onto the printing media P. The printing media P having the toner images fused thereon is discharged outside the image forming apparatus 300 by the discharge conveying roller 361 and the discharging unit 360.

While the image forming apparatus 300 is performing the printing operation, the toner T in the toner cartridge 110 (FIG. 2) is consumed. When the toner of the toner cartridge 110 runs out, the user should replace the empty toner cartridge 110 with a new toner cartridge 110.

Referring to FIGS. 16 and 17, when replacing the toner cartridge 110, the front cover 303 of the image forming apparatus 300 is first opened. Then, the rotation handle 120 of the empty toner cartridge 110 is rotated in the counterclockwise direction and pulled so that the locking blade 121 of the rotation handle 120 is released from the hooking portion 150, so the toner cartridge 110 can be separated from the toner cartridge mounting portion 201 of the developing unit 200.

Referring to FIGS. 13 and 16, a new toner cartridge 110 is inserted to the toner cartridge mounting portion 201 of the developing unit 200. At this time, if the user inserts the reference projection 139 of the toner cartridge 110 into the reference groove 205 of the toner cartridge mounting portion 201, and so pushes the rotation handle 120 forward, the toner cartridge 110 is easily mounted. After completely inserting the toner cartridge 110 in the toner cartridge mounting portion 201, the user rotates the rotation handle 120 so that the locking blade 121 of the rotation handle 120 locates behind the hooking portion 150. Then the front cover 303 (FIG. 17) is closed so that mounting the toner cartridge 110 is completed.

Figure 18:
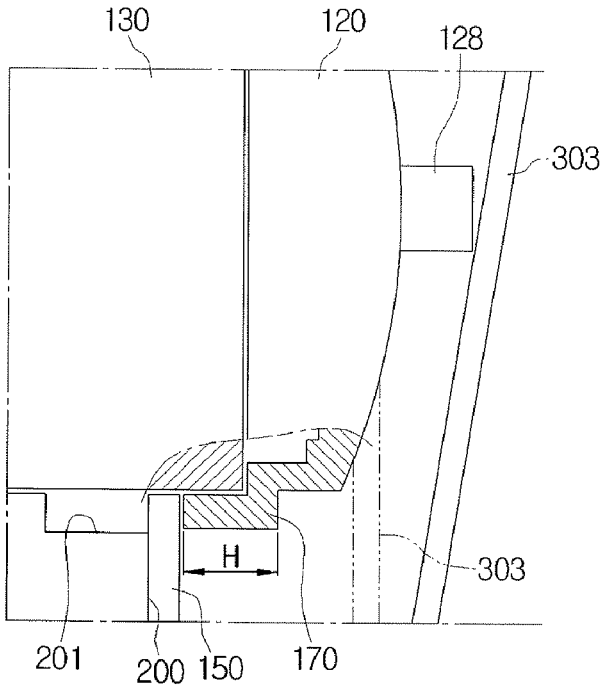
FIG. 18 is a partial sectional view illustrating a toner cartridge according to an exemplary embodiment of the present general inventive concept incompletely locked to a toner cartridge mounting portion.

When the toner cartridge 110 is normally mounted to the toner cartridge mounting portion 201 as illustrated in FIG. 17, there is the gap G between the handle 128 of the rotation handle 120 and the front cover 303 when the front cover 303 is completely closed. However, when the toner cartridge 110 is incompletely inserted in the toner cartridge mounting portion 201, the user rotates the rotation handle 120 so that the inserting projection 170 of the locking blade 121 gets on the hooking portion 150 as illustrated in FIG. 18. As a result, the handle 128 of the rotation handle 120 projects as high as the height H of the inserting projection 170 so that the front cover 303 is not completely closed. Therefore, the toner cartridge locking apparatus 100 according to an exemplary embodiment of the present general inventive concept can prevent the user from operating the image forming apparatus 300 when the toner cartridge 110 is incompletely mounted, that is, the toner cartridge 110 is incompletely inserted in the toner cartridge mounting portion 201.

In the above description, the image forming apparatus 300 provided with four toner cartridges 110 is used as an example; however, this should not be considered as limiting. The toner cartridge locking apparatus 100 according to an exemplary embodiment of the present general inventive concept can be used in the image forming apparatus 300 having at least one toner cartridge 110.

Figure 20:
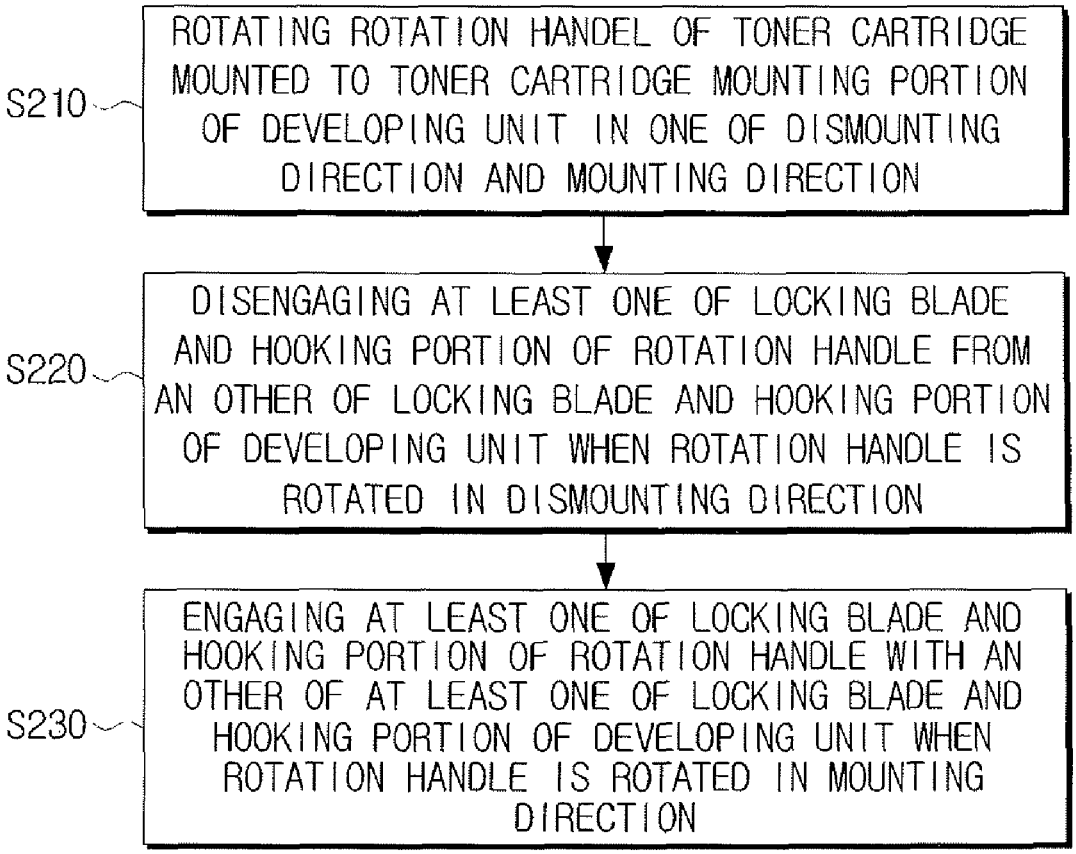
FIG. 20 is a flowchart illustrating a locking/unlocking method of a toner cartridge of an image forming apparatus according to an embodiment of the present general inventive concept.

FIG. 20 is a flowchart illustrating a locking/unlocking method of a toner cartridge of an image forming apparatus according to an embodiment of the present general inventive concept. Referring to FIGS. 2 and 20, in operation S210, the rotation handle 120 of the toner cartridge 110 mounted to the toner cartridge mounting portion 201 of the developing unit 200 rotating in one of a dismounting direction and a mounting direction. In operation S220, when the rotation handle 120 is rotated in the dismounting direction at least one of the locking blade 121 and a hooking portion (not illustrated) of the rotation handle 120 is disengaged from an other of a locking blade (not illustrated) and the hooking portion 150 of the developing unit 200. In operation S230, when the rotation handle 120 is rotated in the mounting direction, at least one of the locking blade 121 and the hooking portion (not illustrated) of the rotation handle 120 is engaged with an other of the at least one of the locking blade (not illustrated) and the hooking portion 150 of the developing unit 200.

The present general inventive concept can also be embodied as computer-readable codes on a computer-readable medium. The computer-readable medium can include a computer-readable recording medium and a computer-readable transmission medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

With the toner cartridge according to various embodiments of the present general inventive concept, the image forming apparatus having the same, and the mounting and dismounting method of the toner cartridge as described above, the toner cartridge is locked by the locking blade of the rotation handle rotatably disposed at the toner tank and the hooking portion disposed at the developing unit so that a variation of the molding dimension of the toner cartridge does not affect mounting and dismounting of the toner cartridge. Therefore, the toner cartridge is mounted to or dismounted from the developing unit in an easy manner.

Furthermore, with the toner cartridge according to various embodiments of the present general inventive concept, the image forming apparatus having the same, and the mounting and dismounting method of the toner cartridge, the rotation handle and hooking portion to mount or dismount the toner cartridge are exposed outside the developing unit so that the user can easily know whether the toner cartridge is locked.

Although various embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A toner cartridge locking apparatus, comprising:

a rotation handle rotatably disposed at a first end of a toner tank, and having a locking blade formed at an outer circumferential surface thereof; and a hooking portion disposed at a developing unit to which the toner tank is mounted, wherein when the rotation handle is rotated in a predetermined angle, the locking blade of the rotation handle is inserted into the hooking portion.

2. The toner cartridge locking apparatus of claim 1, wherein the toner tank comprises a rotation supporting portion formed substantially in a ring shape at the first end of the toner tank; and the rotation handle comprises a rotating portion to rotate with respect to the rotation supporting portion of the toner tank.

3. The toner cartridge locking apparatus of claim 2, wherein the rotating portion of the rotation handle is inserted into one of an inside and an outside of the rotation supporting portion of the toner tank.

4. The toner cartridge locking apparatus of claim 2, wherein at least one of a guiding groove and a guiding projection is formed at the rotation supporting portion of the toner tank.

5. The toner cartridge locking apparatus of claim 4, wherein the rotating portion of the rotation handle comprises at least one of a guiding projection and guiding groove inserted into the at least one of the guiding groove and the guiding projection formed at the rotation supporting portion.

6. The toner cartridge locking apparatus of claim 5, wherein the at least one of the guiding groove and the guiding projection of the rotation supporting portion and the rotating portion are formed so that the rotation handle rotates within 45 degrees.

7. The toner cartridge locking apparatus of claim 2, wherein the rotating portion of the rotation handle is formed substantially in a ring shape, and divided into at least two portions in a diameter direction of the rotation handle.

8. The toner cartridge locking apparatus of claim 2, wherein the rotation handle comprises:

a skirt to enclose the rotating portion.

9. The toner cartridge locking apparatus of claim 8, wherein the locking blade is disposed at the skirt.

10. The toner cartridge locking apparatus of claim 1, wherein the rotation handle comprises:

a handle.

11. The toner cartridge locking apparatus of claim 1, further comprising:

a handle locking member disposed at the toner tank, wherein when the toner tank is not mounted to the developing unit the handle locking member does not allow the rotation handle to rotate, and when the toner tank is mounted to the developing unit the handle locking member allows the rotation handle to rotate.

12. The toner cartridge locking apparatus of claim 11, wherein the handle locking member comprises:

a fixing end fixed to the toner tank; and a free end biased to be separated from the toner tank, and wherein a fixing groove in which the free end of the handle locking member is inserted is formed at an inner surface of the rotation handle.

13. The toner cartridge locking apparatus of claim 12, further comprising:

a pressing projection disposed at the developing unit, wherein when the toner tank is mounted, the pressing projection presses the handle locking member toward the toner tank.

14. The toner cartridge locking apparatus of claim 12, wherein the toner tank comprises:

a pair of protecting protrusions disposed at both sides of the handle locking member.

15. The toner cartridge locking apparatus of claim 1, wherein the locking blade of the rotation handle comprises:

an inserting projection to project toward the toner tank.

16. A toner cartridge locking apparatus, comprising:

a rotation handle rotatably disposed at a first end of a toner tank, and having a locking blade formed at an outer circumferential surface thereof;

a hooking portion disposed at a developing unit to which the toner tank is mounted so that when the rotation handle is rotated in a predetermined angle, the locking blade of the rotation handle is inserted into the hooking portion; and a handle locking member disposed at the toner tank so that when the toner tank is not mounted to the developing unit, the handle locking member does not allow the rotation handle to rotate, and when the toner tank is mounted to the developing unit, the handle locking member allows the rotation handle to rotate.

17. The toner cartridge locking apparatus of claim 16, wherein the toner tank comprises a rotation supporting portion formed substantially in a ring shape at the first end of the toner tank; and the rotation handle comprises a rotating portion inserted in the rotation supporting portion of the toner tank to rotate with respect to the rotation supporting portion, and a fixing groove in which the handle locking member is inserted.

18. The toner cartridge locking apparatus of claim 16, wherein the locking blade of the rotation handle comprises:

an inserting projection to project toward the toner tank.

19. The toner cartridge locking apparatus of claim 16, further comprising:

a pressing projection disposed at the developing unit to press the handle locking member toward the toner tank.

20. An image forming apparatus, comprising:

a printing medium supplying unit disposed in a body and supplying a printing medium sheet by sheet;

a laser scanning unit emitting a laser beam corresponding to printing data;

a developing unit including a photosensitive medium on which an electrostatic latent image is formed by the laser beam emitted by the laser scanning unit, and at least one toner cartridge mounting portion to which at least one toner cartridge to supply the photosensitive medium with toner and develop the electrostatic latent image into a toner image is mounted;

a toner cartridge locking apparatus to lock the at least one toner cartridge mounted to the at least one toner cartridge mounting portion of the developing unit, as recited in any one of the claims 1 to 19;

a transfer unit disposed to face the photosensitive medium and transferring the toner image formed on the photosensitive medium to the printing medium; and a front cover disposed at the main body to cover a front surface of the developing unit in which the at least one toner cartridge mounting portion is formed.

21. The image forming apparatus of claim 20, wherein the developing unit comprises four toner cartridges and four toner cartridge mounting portions, wherein one toner cartridge among the four toner cartridges has a larger size than the other three toner cartridges.

22. The image forming apparatus of claim 21, wherein the larger size toner cartridge includes an extension portion, and the toner cartridge mounting portion in which the larger size toner cartridge is inserted includes an extension groove corresponding to the extension portion of the toner cartridge, wherein the extension groove is formed not to be interfered with the other three toner cartridge mounting portions to which the other threw toner cartridges are mounted.

23. A mounting method of a toner cartridge, the mounting method comprising:

inserting the toner cartridge into a toner cartridge mounting portion of a developing unit; and rotating a rotation handle of the toner cartridge so that a locking blade of the rotation handle rotates in a same direction as the rotation direction of the rotation handle to be caught on a hooking portion of the developing unit.

24. The mounting method of claim 23, wherein a width of the rotation handle is wider than a width of the locking blade.

25. The mounting method of claim 23, wherein when the rotation handle rotates 45 degrees, the locking blade of the rotation handle is caught on the hooking portion of the developing unit.

26. A mounting method of a toner cartridge, the mounting method comprising:

inserting the toner cartridge having a rotation handle into a toner cartridge mounting portion of a developing unit;

causing a pressing projection disposed at the toner cartridge mounting portion to press a handle locking member of the toner cartridge so that the handle locking member is released from a fixing groove of the rotation handle; and rotating the rotation handle of the toner cartridge so that a locking blade of the rotation handle is caught on a hooking portion of the developing unit.

27. The mounting method of claim 26, wherein when the toner cartridge is inserted into the toner cartridge mounting portion, a reference projection of the toner cartridge is aligned to a reference groove formed at the toner cartridge mounting portion.

28. A dismounting method of a toner cartridge, the dismounting method comprising:

rotating a rotation handle of the toner cartridge mounted to a toner cartridge mounting portion of a developing unit so that a locking blade of the rotation handle is released from a hooking portion of the developing unit; and separating the toner cartridge from the toner cartridge mounting portion of the developing unit.

29. The dismounting method of claim 28, wherein when the rotation handle rotates 45 degrees, the locking blade of the rotation handle is released from the hooking portion of developing unit.

30. The dismounting method of claim 28, wherein when separating the toner cartridge from the toner cartridge mounting portion, the handle locking member of the toner cartridge is inserted into a fixing groove of the rotation handle.

31. A toner cartridge that is detachably disposed at a developing unit of an image forming apparatus, the toner cartridge comprising:

a toner tank to store toner; and a rotation handle rotatably disposed at a first end of the toner tank, and having a locking blade formed at an outer circumferential surface thereof;

wherein when the rotation handle rotates in predetermined angles, the locking blade is caught on a hooking portion disposed at the developing unit.

32. The toner cartridge of claim 31, wherein the toner tank comprises a rotation supporting portion formed substantially in a ring shape at the first end of the toner tank; and the rotation handle comprises a rotating portion inserted in the rotation supporting portion of the toner tank to rotate with respect to the rotation supporting portion.

33. The toner cartridge of claim 32, wherein the rotating portion of the rotation handle is inserted into one of an inside and an outside of the rotation supporting portion of the toner tank.

34. The toner cartridge of claim 33, wherein at least one of a guiding groove and a guiding projection is formed at the rotation supporting portion of the toner tank, and the rotating portion of the rotation handle comprises at least one of a guiding projection and a guiding groove inserted into the at least one of the guiding groove and the guiding projection formed at the rotation supporting portion.

35. The toner cartridge of claim 34, wherein the at least one of the guiding groove and the guiding projection of the rotation supporting portion and the rotating portion are formed so that the rotation handle rotates within 45 degrees.

36. The toner cartridge of claim 32, wherein the rotating portion of the rotation handle is formed substantially in a ring shape, and divided into at least two portions in a diameter direction.

37. The toner cartridge of claim 32, wherein the rotation handle comprises:

a skirt to enclose the rotating portion.

38. The toner cartridge of claim 37, wherein the locking blade is disposed at the skirt.

39. The toner cartridge of claim 31, wherein the rotation handle comprises:

a handle.

40. The toner cartridge of claim 31, further comprising:

a handle locking member disposed at the toner tank, wherein when the toner tank is not mounted to the developing unit the handle locking member does not allow the rotation handle to rotate, and when the toner tank is mounted to the developing unit the handle locking member allows the rotation handle to rotate.

41. The toner cartridge of claim 40, wherein the handle locking member comprises a fixing end fixed to the toner tank, and a free end biased to be separated from the toner tank, and wherein a fixing groove in which the free end of the handle locking member is inserted is formed at an inner surface of the rotation handle.

42. The toner cartridge of claim 40, further comprising:

a pressing projection disposed at the developing unit, wherein when the toner tank is mounted, the pressing projection presses the handle locking member toward the toner tank.

43. The toner cartridge of claim 40, wherein the toner tank comprises:

a pair of protecting protrusions disposed at both sides of the handle locking member.

44. The toner cartridge of claim 31, wherein the locking blade of the rotation handle comprises:

an inserting projection to project toward the toner tank.

45. A toner tank of a toner cartridge detachably disposed at a developing unit of an image forming apparatus, the toner tank storing toner and comprising a rotation handle rotatably disposed at one end of the toner tank and having a locking blade, wherein when the toner tank is mounted to the developing unit and the rotation handle is rotated in a predetermined angle, the locking blade is caught on a hooking portion disposed at the developing unit so that the toner tank is locked to the developing unit.

46. The toner tank of claim 45, wherein a handle locking member disposed at the toner tank, wherein when the toner tank is not mounted to the developing unit the handle locking member does not allow the rotation handle to rotate, and when the toner tank is mounted to the developing unit the handle locking member allows the rotation handle to rotate.

47. A rotation handle of a toner cartridge detachably disposed at a developing unit of an image forming apparatus, the rotation handle rotatably disposed at one end of the toner tank of the toner cartridge and comprising a locking blade disposed at an outer circumferential surface thereof, wherein when the toner tank is mounted to the developing unit and the rotation handle is rotated in a predetermined angle, the locking blade is caught on a hooking portion disposed at the developing unit so that the toner cartridge is locked to the developing unit.

48. The rotation handle of claim 47, wherein the rotation handle further comprises a fixing groove in which a handle locking member disposed at the toner tank of the toner cartridge is inserted, wherein when the toner tank is not mounted to the developing unit, the handle locking member is inserted in the fixing groove so that the rotation handle does not rotate, and when the toner tank is mounted to the developing unit, the handle locking member is released from the fixing groove so that the rotation handle rotates.

49. A toner tank that is disposed at a developing unit of an image forming apparatus and stores toner, the toner tank comprising:

a toner supplying portion to discharge the toner; and a locking blade and a rotation handle disposed opposite the toner supplying portion in a lengthwise direction of the toner tank;

wherein when the toner tank is mounted to the developing unit and the rotation handle is rotated in one direction, the locking blade is caught on a hooking portion disposed at the developing unit so that the toner tank is locked to the developing unit.

50. The toner tank of claim 49, wherein when the locking blade is caught on the hooking portion, the locking blade locates at a level equal to or lower than a level of the toner supplying portion.

51. The toner tank of claim 49, wherein a width of the locking blade is narrower than a width of the rotation handle.

52. The toner tank of claim 49, wherein the toner tank comprises:

an extension portion to project in a height direction of the toner tank in a direction opposite to the toner supplying portion when the toner tank is mounted to the developing unit.

53. The toner tank of claim 52, wherein the extension portion of the toner tank is formed to have a section formed in a portion of an ellipse shape, and wherein when a plurality of toner tanks is disposed at the developing unit of the image forming apparatus, the toner tank to store a greatest amount of toner includes the extension portion.

54. The toner tank of claim 49, wherein another toner tank is disposed at the developing unit in the vicinity of the toner tank, wherein the toner tank comprises an extension portion projecting upwardly in a direction in which the toner tank is not interfered with the another toner tank.

55. A toner cartridge locking apparatus usable with an image forming apparatus, the toner cartridge locking apparatus comprising:

a toner tank mounted on a developing unit and comprising once of the locking blade and a hooking portion; and a rotation handle disposed on the toner tank, and having the other one of the locking blade and the hooking portion, wherein the rotation handle is rotated in one direction, the locking blade is caught on the hooking portion, when the rotation handle is rotated in the other direction, the locking blade is released from the hooking portion.

56. A locking/unlocking method of a toner cartridge of an image forming apparatus, for locking/unlocking the toner cartridge to/from a developing unit by rotating a rotation handle of the toner cartridge mounted to a toner cartridge mounting portion of the developing unit in one of the dismounting direction and a mounting direction, the locking/unlocking method comprising:

disengaging one of a locking blade and a hooking portion disposed at the rotation handle from the other one of the locking blade and the hooking portion disposed at the developing unit when the rotation handle is rotated in the dismounting direction; and engaging one of the locking blade and the hooking portion of the rotation handle with the other one of the locking blade and the hooking portion of the developing unit when the rotation handle is rotated in the mounting direction.

* * * * *